US008720116B1

(12) United States Patent
Ahmad

(10) Patent No.: US 8,720,116 B1
(45) Date of Patent: May 13, 2014

(54) HANDS-FREE DOOR OPENER ASSEMBLY

(71) Applicant: Abdulaziz Kh. M. A. A. Ahmad, Safat (KW)

(72) Inventor: Abdulaziz Kh. M. A. A. Ahmad, Safat (KW)

( * ) Notice: Subject to any disclaimer, the term of this patent is extended or adjusted under 35 U.S.C. 154(b) by 0 days.

(21) Appl. No.: 13/933,004

(22) Filed: Jul. 1, 2013

(51) Int. Cl.
*E05B 1/00* (2006.01)

(52) U.S. Cl.
USPC ..... 49/460; 9/460; 9/461; 9/400; 16/431; 16/412

(58) Field of Classification Search
USPC ..... 49/460, 461, 400; 16/431, 412; 292/194, 195, 198, 200, DIG. 65
See application file for complete search history.

(56) References Cited

U.S. PATENT DOCUMENTS

| | | | | | |
|---|---|---|---|---|---|
| 1,201,848 | A | * | 10/1916 | Merritt | 292/200 |
| 1,487,264 | A | | 3/1924 | Raymer | |
| 1,886,828 | A | * | 11/1932 | Mears | 292/197 |
| 2,238,513 | A | * | 4/1941 | Ward | 292/347 |
| D165,976 | S | * | 2/1952 | Goserud | D8/341 |
| 2,835,524 | A | * | 5/1958 | Russell | 292/128 |
| 2,853,541 | A | * | 9/1958 | Lindgren | 49/400 |
| 3,121,907 | A | * | 2/1964 | Stebbins | 16/412 |
| 3,159,093 | A | * | 12/1964 | Rosenfeld | 49/401 |
| 5,603,184 | A | * | 2/1997 | Campbell et al. | 49/394 |
| 6,189,183 | B1 | | 2/2001 | Hartselle | |
| 6,196,599 | B1 | * | 3/2001 | D'Hooge | 292/165 |
| 6,293,598 | B1 | * | 9/2001 | Rusiana | 292/143 |
| 6,382,750 | B1 | * | 5/2002 | King | 312/319.9 |
| 7,716,789 | B1 | * | 5/2010 | Zevallos | 16/412 |
| 7,810,215 | B2 | * | 10/2010 | Houis | 16/412 |
| 8,522,482 | B2 | * | 9/2013 | Buck | 49/460 |
| 2012/0198774 | A1 | * | 8/2012 | Buck | 49/381 |

* cited by examiner

*Primary Examiner* — Katherine Mitchell
*Assistant Examiner* — Marcus Menezes
(74) *Attorney, Agent, or Firm* — Richard C Litman

(57) ABSTRACT

The hands-free door opener assembly permits a person to open, close and lock a door by employing a forearm or elbow. The system comprises respective push handle members disposed on both the interior and exterior surfaces of the door. Pushing either handle member functions to pivot a latch out of engagement with a latch plate positioned in the door frame. A door opening spring-biased plate is mounted on the latch plate to provide an assist to open the door when the latch is disengaged. The door is provided with a hands-free locking structure on the interior surface. An occupancy alert is disposed on the exterior surface of the door.

11 Claims, 8 Drawing Sheets

HANDS-FREE DOOR OPENER ASSEMBLY

BACKGROUND OF THE INVENTION

1. Field of the Invention

The present invention generally relates to door latch assemblies, and particularly to a hands-free door opener assembly that permits hands-free operation.

2. Description of the Related Art

It is well established that the spread of infectious diseases between humans is frequently due to interaction by touch. The bacteria and/or viruses are picked up by the hand(s) and are transmitted to the mouth or nose, simply by touch. Retail establishments sometimes provide antiseptic wipes so that a customer may wipe down apparatus or hardware in an effort to allay transmission of harmful bacteria and/or viruses. The aforementioned harmful bacteria and viruses are known to be prevalent on the door handles of public restrooms, hospitals, restaurants, theaters, etc. The sight of a person attempting to avoid hand contact with a door handle in these facilities is a frequently observed phenomenon. There have been many attempts in the related art, aside from the provision of antiseptic wipes, to prevent a user from contacting a contaminated door handle. Handles requiring insertion of a wrist or forearm have proven to be operationally cumbersome. Doors that employ foot pedal manipulation to open are expensive to install. The industry would certainly welcome a relatively inexpensive opening system that requires only minimal push contact by the forearm to open the door, thereby avoiding the need to touch the handle with the hand. Thus, a hands-free door opener assembly solving the aforementioned problems is desired.

SUMMARY OF THE INVENTION

The present invention is a hands-free door opener assembly that permits a person to open, close, and lock a door by employing a forearm or elbow. The assembly comprises respective push handle members disposed on both the interior and exterior faces of the door. Pushing either handle member functions to pivot a latch out of engagement with a latch cavity that is positioned in the door frame. A door-opening spring member is mounted on the door frame to provide an assist to open the door when the latch is disengaged. The door is provided with a hands-free locking mechanism on the interior surface. An occupancy alert is disposed on the exterior surface of the door.

Accordingly, the invention presents a hands-free door opening assembly that is easy to use, durable and effective in maintaining a high level of hygiene. The assembly permits operation even if the user's hands are full and can be effectively utilized by disabled persons. The invention provides for improved elements thereof in an arrangement for the purposes described that are inexpensive, dependable and fully effective in accomplishing their intended purposes.

These and other features of the present invention will become readily apparent upon further review of the following specification and drawings.

DETAILED DESCRIPTION OF THE PREFERRED EMBODIMENTS

Figure 1:
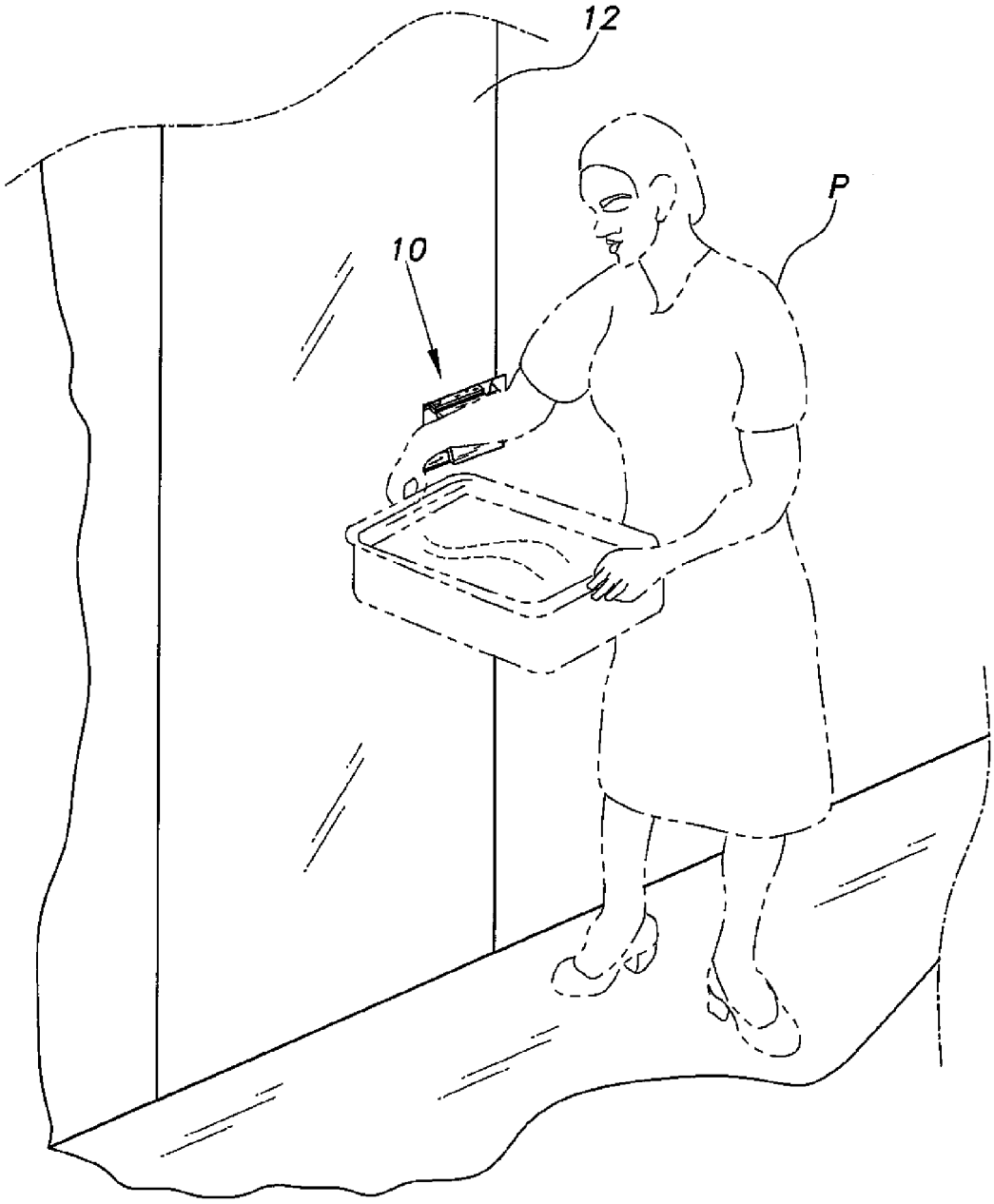
FIG. 1 is an environmental, perspective view of a hands-free door opener assembly according to the present invention.
Figure 2:
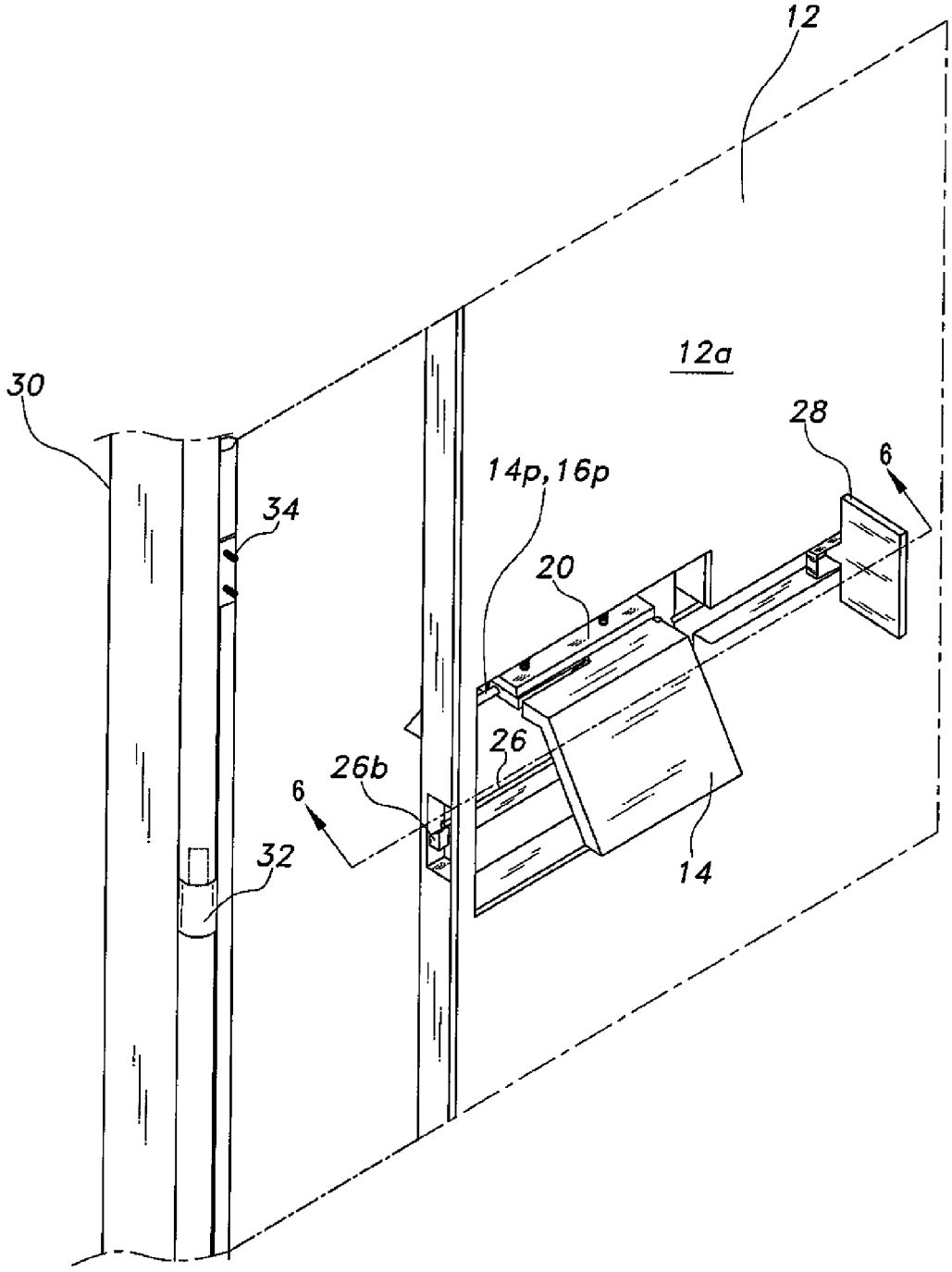
FIG. 2 is a partial perspective view of a hands-free door opener assembly according to the present invention, showing the interior face of the door.
Figure 3:
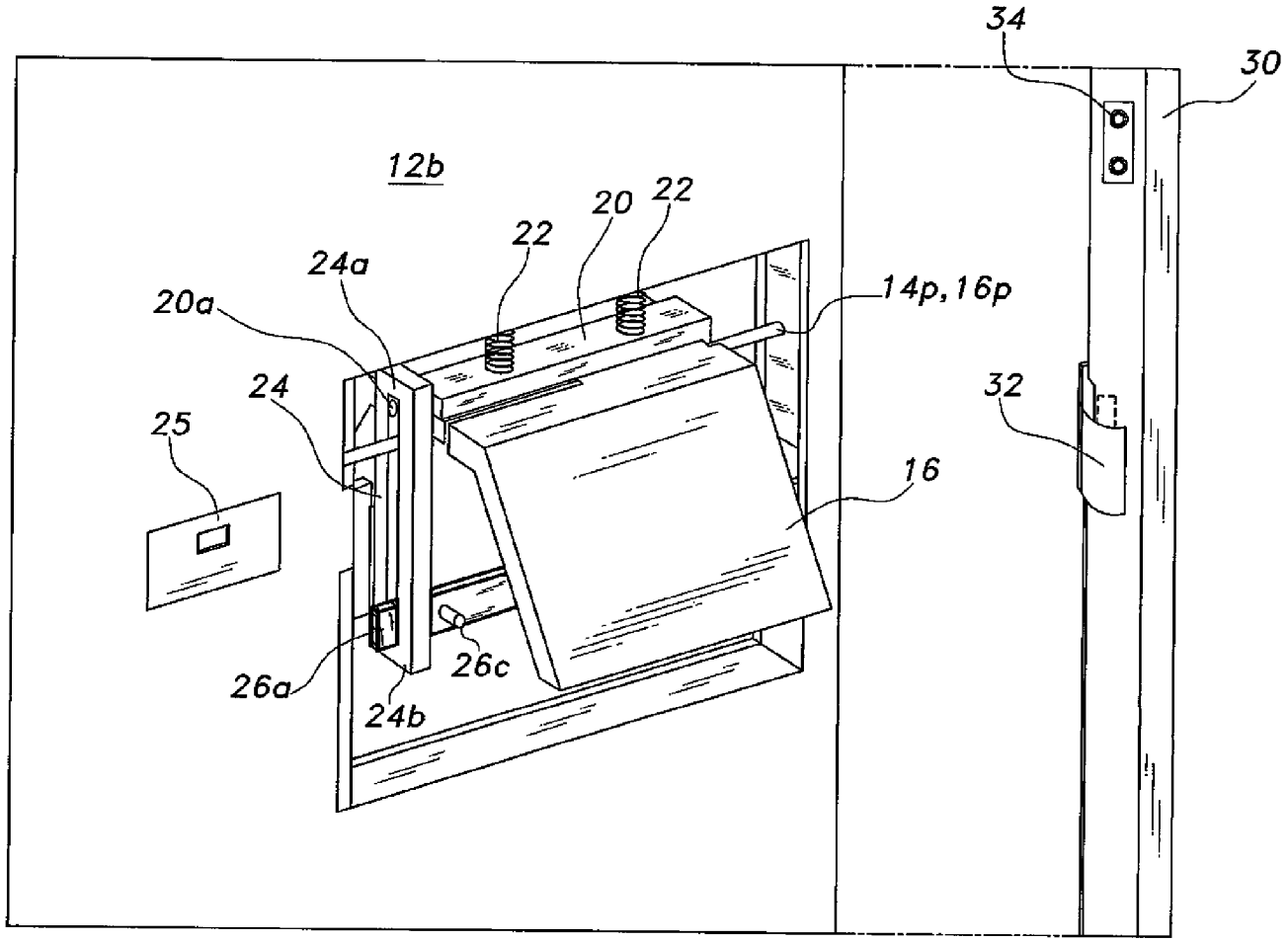
FIG. 3 is a partial perspective view of a hands-free door opener assembly according to the present invention, showing the exterior face of the door.

Attention is first directed to FIGS. 1-3 wherein the hands-free door opener assembly of the instant invention is generally indicated at 10. The handle mechanism of assembly 10 is disposed in an opening formed in door 12 and includes identically configured push plates 14, 16 respectively positioned on the interior and exterior surfaces 12*a*, 12*b* of door 12. The push plates 14, 16 are plates bent to form an obtuse angle, and are pivotally attached to the door, via 14*p*, 16*p*. The longer, free portion of the plates 14, 16 can be manipulated by the forearm or elbow of a person P desiring to open the door 12. As best seen in FIGS. 2 and 3, the handle mechanism further includes a bar member 20 having springs 22 that bias the bar member 20 downward into contact with the top of push plates 14, 16. When either push plate 14 or 16 is pushed, in a direction perpendicularly into the door, shown by arrow indicator 14*i*, the smaller leg 14*t*, 16*t* of the plate 14, 16 presses the bar member 20 upward, compressing the springs 22. A connector member 24, which is a rectangular plate having an elongated slot defined therein, has an upper end 24*a* rigidly attached to one end of the bar member 20 and extends downward therefrom. The connector member 24 terminates in a lower free end 24*b*. The slot in the connector member 24 receives one end 26*a* of a latch member 26. The other end of latch member 26 terminates in a latch head 26*b*. Latch member 26 is provided with and is movable on a pivot axis 26*c*. A locking structure 28, whose function is more fully explained below, is positioned for lateral movement (note bi-directional arrow 29) on the handle mechanism. When the bar member 20 is raised upward against the bias of the springs 22, the connector member 24 is pulled upward with it, thereby pivoting the latch member 26.

Figure 4:
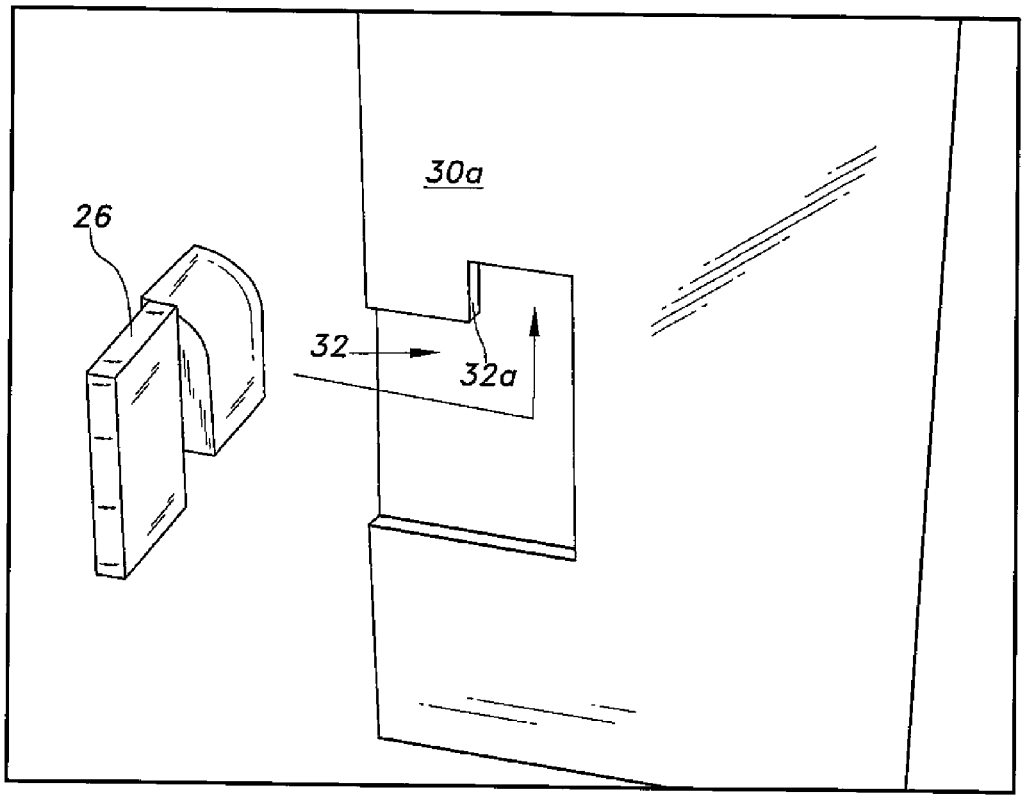
FIG. 4 is a cut-away perspective view of the door frame cavity of a hands-free door opener assembly according to the present invention.
Figure 5:
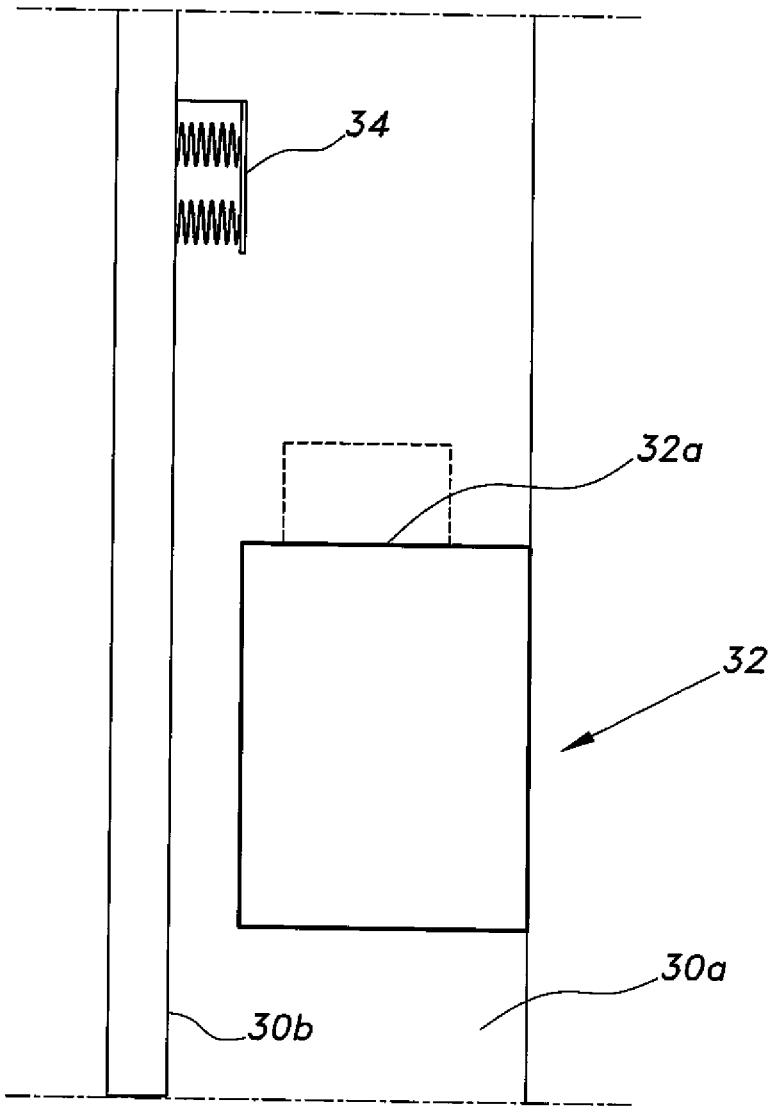
FIG. 5 is a partial side view of the door frame, showing the door frame cavity and pusher plate arrangement of a hands-free door opener assembly according to the present invention.
Figure 8:
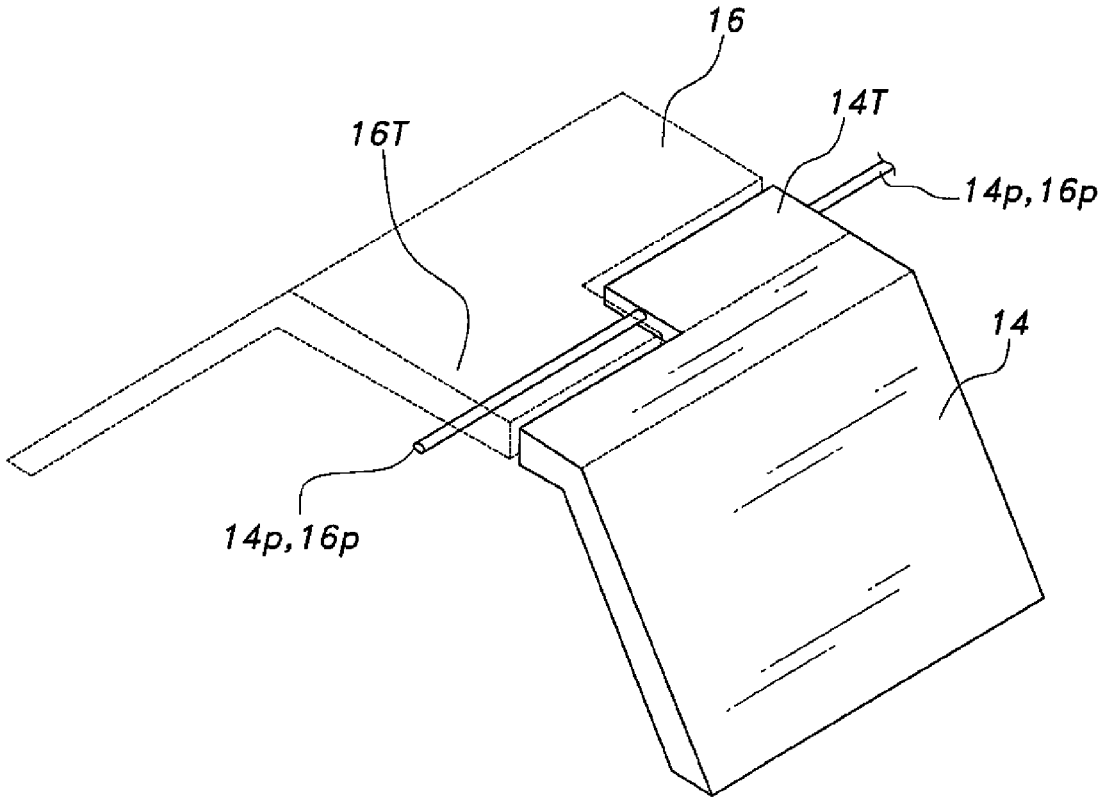
FIG. 8 is a perspective view of the push handle structures of a hands-free door opener assembly according to the present invention.

As seen in FIG. 8, the handles 14, 16 have a top portion or smaller leg 14*t*, 16*t* that is disposed under plate 20. Handles 14, 16 have a common pivoting axis defined along the pivot rod 14*p*, 16*p*. When the handles 14, 16 are pushed, the pivoting along rod 14*p*, 16*p* causes the smaller leg 14*t*, 16*t* to move upwardly, pushing plate upward against the biasing of the springs 22. As best seen in FIGS. 4 and 5 a latch plate 30 is positioned in a door jamb opposite the door 12. The latch plate 30 has an edge portion 30*a* on the edge of the door jamb and a face portion 30*b* on the wall orthogonal to the door jamb. An L-shaped cavity 32 is formed in edge portion 30*a*, which is positioned to receive the latch head 26*b* of the latch member 26 therein. The L-shaped cavity 32 has an elongated arm defining a retaining edge 32*a* that is positioned to abut the latch head 26*b* to normally hold the door 12 in a closed position. A spring-biased pusher plate 34 is mounted on the face portion 30*b*.

Figure 6A:
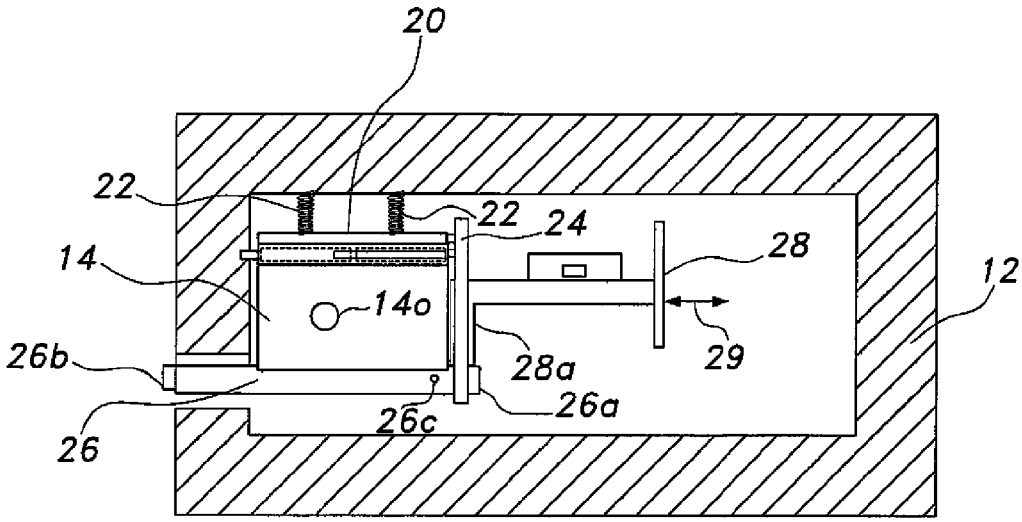
FIG. 6A is a top view of the interconnecting locking structure and latch mechanism of a hands-free door opener assembly according to the present invention, partially in section, shown in a position to lock the door.
Figure 6B:
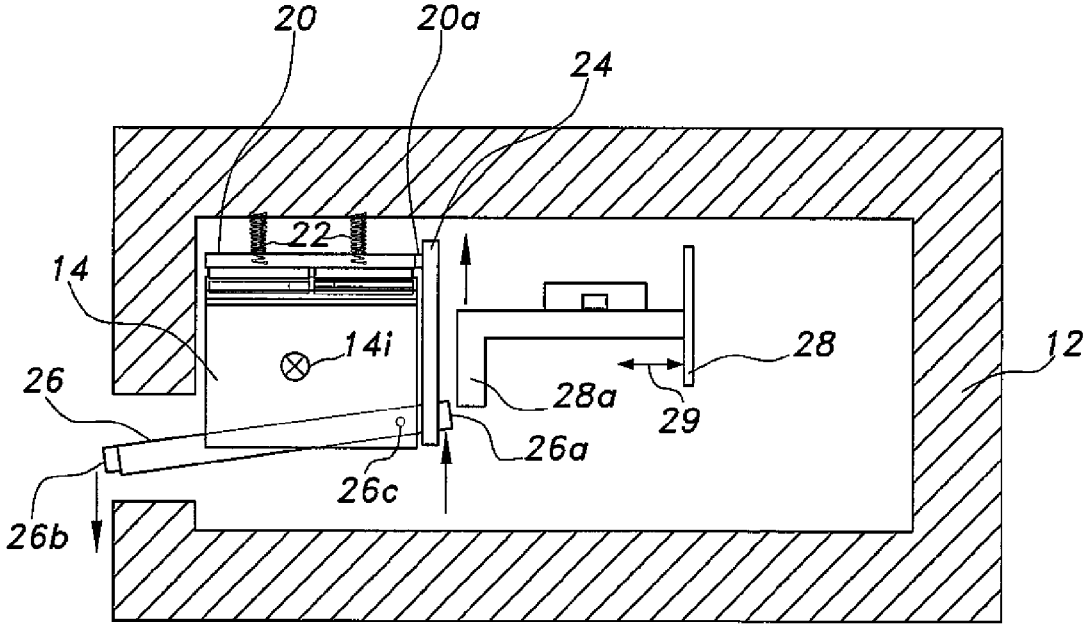
FIG. 6B is a top view of the interconnecting locking structure and latch mechanism of a hands-free door opener assembly according to the present invention, partially in section, shown in a position unlocking the door.
Figure 7:
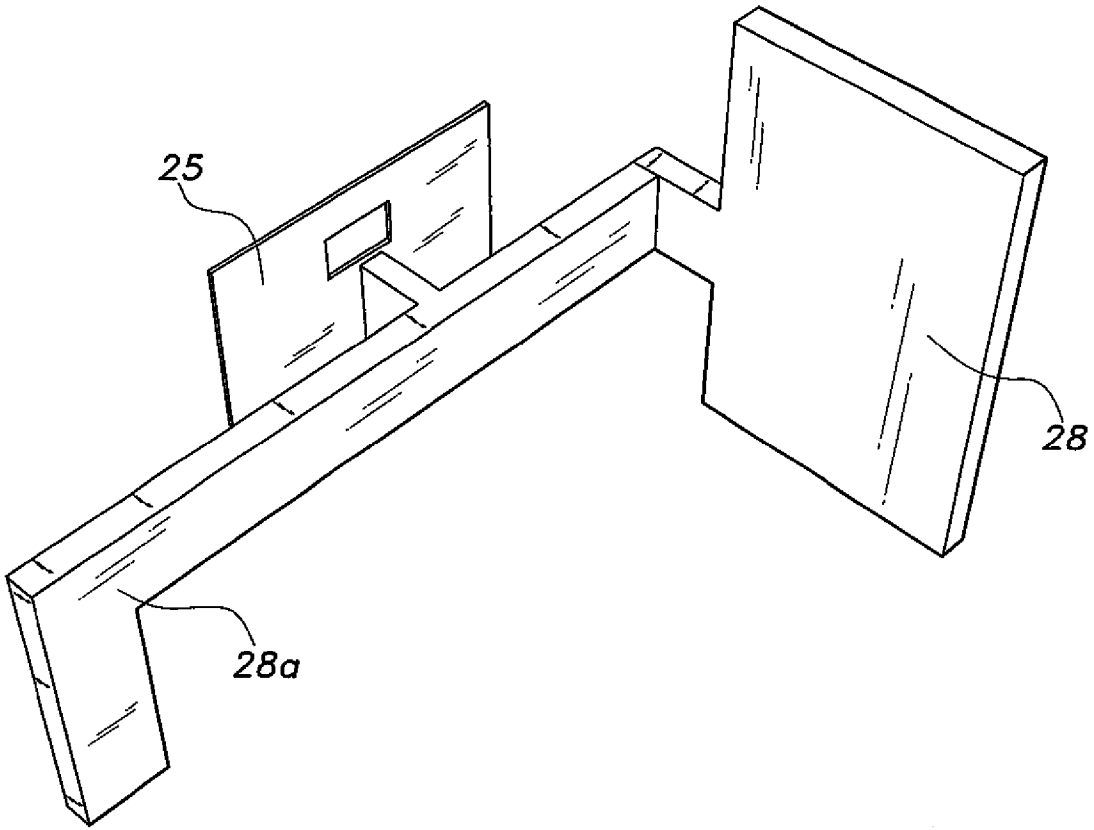
FIG. 7 is a perspective view of the interconnecting locking structure of a hands-free door opener assembly according to the present invention.

In use, when door 12 is closed, the latch head 26*a* of latch member 26 extends into the elongated arm of the L-shaped cavity 32 and engages the retaining edge 32*a* of cavity 32, being held in that position by spring bias of the springs 22, whereby the door is prevented from opening. When it is desired to open the door from the interior or exterior side, one simply engages a push handle, 14, 16, with forearm, elbow, etc. to cause the handle to pivot, via 14*p*, 16*p*, and press against the bar member 20. Moving either handle 14, 16, from the outwardly extended position (shown as arrow indicator 14*o*) to the inwardly pushed position (as shown by the arrow indicator 14*p*), will cause the bar 20 and connector 24 members to move upward. Upward movement of the connector member 24 causes latch member 26 to pivot, via pivot point 26*c*, whereby latch head 26*b* pivots downward out of the elongated arm of the L-shaped cavity 32 and allow the door to be swung open. Spring-biased pusher plate 34 provides an assist for opening the door. When the door is reclosed, springs 22 function to return bar 20 and connector member 24 to their normal positions thereby allowing the latch head to re-engage the edge 32*a* of cavity 32. Locking structure 28 may be moved laterally inward to prevent plates 14, 16 from moving, thereby effectively locking the door. The locking structure is interconnected with an occupancy indicator to cause the indicator to appear at 25 on the exterior surface of the door when the door is locked. As shown in FIGS. 6A, 6B, and 7 by moving the locking structure 28 towards the door, the L-shaped member 28*a* will be in the way of the latch 26, which will prevent the handle from moving. The locking structure can be manipulated with the forearm or elbow.

It is to be understood that the present invention is not limited to the embodiments described above, but encompasses any and all embodiments within the scope of the following claims.

I claim:

1. A door assembly, comprising:

a door having an exterior surface, an interior surface and an opening formed therethrough;

a handle mechanism pivotally disposed in the opening;

wherein the handle mechanism pivots in a direction towards the door;

a movable latch member attached to the handle mechanism, the latch member having a first end and a second end, the second end having a latch head;

a door jamb disposed adjacent the door;

a latch plate mounted on the door jamb, the latch plate having an L-shaped cavity formed therein, the cavity having an elongate arm extending upward and defining an edge adapted to engage the latch head to latch the door in a closed position;

means for moving said latch member to disengage the latch head from the elongated arm of the L-shaped cavity to unlatch the door and allow the door to be opened; and a spring-biased plate mounted on the door jamb to provide an assist to open the door, wherein said latch head is pivotally mounted on an axis for pivoting movement thereon to engage the latch head with the latch plate to latch the door in a closed position.

2. The door assembly according to claim 1, wherein the latch plate includes an edge portion and a face portion, the cavity being defined in the edge portion.

3. The door assembly according to claim 1, wherein said latch plate includes an edge portion and a face portion, said spring-biased plate being mounted on the face portion.

4. The door assembly according to claim 1, wherein said handle mechanism includes respective pivotal push plates extending on the interior surface and the exterior surface of said door.

5. The door assembly according to claim 1, further including a movable locking structure mounted on said handle mechanism for optionally preventing movement of said means for moving said latch member.

6. The door assembly according to claim 5, wherein said movable locking structure is mounted adjacent the interior surface of said door.

7. A door assembly, comprising:

a door having an exterior surface, an interior surface, and an opening formed therethrough;

a handle mechanism pivotally disposed in the opening;

wherein the handle mechanism pivots in a direction substantially perpendicular to the surface of the door;

a latch member attached to the handle mechanism, the latch member having a first end and a second end and being mounted on an axis for pivoting movement thereon, the latch member having a latch head defined at the first end;

a door jamb disposed adjacent the door;

a latch plate mounted on the door jamb, the latch plate having an L-shaped cavity formed therein, the cavity having an elongate arm extending upward and defining an edge adapted to engage the latch head to latch the door in a closed position;

means for pivoting the latch member to disengage the latch head from the latch plate to allow the door to be opened;

a movable locking structure mounted on the handle mechanism for optionally preventing movement of the means for pivoting the latch member; and a spring-biased plate mounted on the door jamb to provide an assist to open the door, wherein said latch head is pivotally mounted on an axis for pivoting movement thereon to engage the latch head with the latch plate to latch the door in a closed position.

8. The door assembly according to claim 7, wherein said latch plate includes an edge portion and a face portion, the cavity being disposed in the edge portion.

9. The door assembly according to claim 7, wherein said latch plate includes an edge portion and a face portion, said spring-biased plate being mounted on the face portion.

10. The door assembly according to claim 7, wherein said handle mechanism includes respective pivotal push plates extending on the interior surface and exterior surface of said door.

11. The door assembly according to claim 7, further including a movable locking structure mounted on said handle mechanism for optionally preventing movement of said means for moving said latch member, said movable locking structure being mounted adjacent the interior surface of said door.

* * * * *